US006488354B2

(12) United States Patent
Hosono

(10) Patent No.: US 6,488,354 B2
(45) Date of Patent: Dec. 3, 2002

(54) LIQUID JETTING APPARATUS

(75) Inventor: Satoru Hosono, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 76 days.

(21) Appl. No.: 09/729,101

(22) Filed: Dec. 5, 2000

(65) Prior Publication Data

US 2001/0003349 A1 Jun. 14, 2001

(30) Foreign Application Priority Data

Dec. 7, 1999 (JP) ..... 11-347638
Jan. 17, 2000 (JP) ..... 2000-008385

(51) Int. Cl.[7] ..... B41J 2/165; B41J 29/38
(52) U.S. Cl. ..... 347/23; 347/14
(58) Field of Search ..... 347/23, 27, 1–19, 347/6, 12, 10, 11, 14

(56) References Cited

U.S. PATENT DOCUMENTS

| | | | |
|---|---|---|---|
| 5,517,217 A | 5/1996 | Haselby et al. | 347/23 |
| 5,625,384 A | 4/1997 | Numata et al. | 347/23 |

FOREIGN PATENT DOCUMENTS

| | | |
|---|---|---|
| EP | 0 622 195 | 11/1994 |
| EP | 0 782 924 | 7/1997 |
| JP | 3-164258 | 7/1991 |
| JP | 4-339661 | 11/1992 |
| JP | 6-246931 | 9/1994 |
| JP | 7-144419 | 6/1995 |
| JP | 8-174863 | 7/1996 |
| JP | 9-30007 | 2/1997 |
| JP | 9-201960 | 8/1997 |
| JP | 10-6526 | 1/1998 |
| JP | 10-6527 | 1/1998 |
| JP | 10-81012 | 3/1998 |
| JP | 10-81013 | 3/1998 |
| JP | 10-329336 | 12/1998 |

*Primary Examiner*—Raquel Yvette Gordon
*Assistant Examiner*—Charles W. Stewart, Jr.
(74) *Attorney, Agent, or Firm*—Oblon, Spivak, McClelland, Maier & Neustadt, P.C.

(57) ABSTRACT

A liquid jetting apparatus of the invention includes a head having a nozzle, and a recovering unit that can recover a suitable viscosity of liquid in the nozzle from an increased viscosity thereof. A pressure-generating unit can change a pressure of liquid in the nozzle in order to jet a drop of the liquid from the nozzle, based on jetting data. An obtaining unit can obtain minimum-volume information of the drop of the liquid to be jetted from the nozzle by the pressure-generating unit. A controller can control the recovering unit, based on the minimum-volume information obtained by the obtaining unit.

34 Claims, 12 Drawing Sheets

LIQUID JETTING APPARATUS

FIELD OF THE INVENTION

This invention relates to a liquid jetting apparatus having a head capable of jetting a drop of liquid from a nozzle. In particular, this invention is related to a liquid jetting apparatus that can prevent viscosity of liquid in a nozzle of a head from increasing.

BACKGROUND OF THE INVENTION

In a ink-jetting recording apparatus such as an ink-jetting printer or an ink-jetting plotter (a kind of liquid jetting apparatus), a recording head (head) can be moved in a main scanning direction, and a recording paper (a kind of recording medium) can be moved in a sub-scanning direction perpendicular to the main scanning direction. While the recording head is moved in the main scanning direction, a drop of ink can be jetted from a nozzle of the recording head onto the recording paper. Thus, an image including a character or the like can be recorded on the recording paper. For example, the drop of ink can be jetted by changing pressure of the ink in a pressure chamber communicating with the nozzle.

The pressure of the ink may be changed by utilizing a pressure-generating member, for example a heating member or a piezoelectric vibrating member. In a former case, the heating member can generate a Joule heat based on a supplied driving-pulse in order to generate an air bubble in the pressure chamber. When a volume of the air bubble is changed, the pressure of the ink in the pressure chamber may be changed. Then, the drop of ink is jetted from the nozzle. In a latter case, the piezoelectric vibrating member can be deformed based on a supplied driving-pulse in order to change a volume of the pressure chamber. When the volume of the pressure chamber is changed, the pressure of the ink in the pressure chamber may be changed. Then, the drop of ink is jetted from the nozzle.

The ink in the nozzles of the recording head is held by surface tension thereof and exposed to air. Thus, solvent of the ink such as water may gradually evaporate to increase a viscosity of the ink in the nozzle. In the case, quality of recorded images may deteriorate because the ink having a great viscosity may be jetted toward a direction deviated from a normal direction. In addition, in the case, drops of the ink having uneven volumes may be jetted.

To prevent the viscosity of the ink in the nozzles from increasing, some measures have been proposed. One of the measures is to forcibly discharge (jet out) ink having an increased viscosity from the nozzle outside an objective recording area (flushing operation). Another one of the measures is to cause a meniscus of the ink to minutely vibrate to stir the ink (stirring operation). The meniscus means a free surface of the ink exposed at an opening of the nozzle.

Such a conventional measure is conducted in such a uniform operational condition that a normal ink-jetting operation can be achieved even if the viscosity of the ink in the nozzle tends to increase most. For example, if a recording apparatus can perform a recording operation by using any of a large drop of the ink, a middle drop of the ink and a small drop of the ink, the viscosity of the ink in the nozzle tends to affect the printing operation most when the small drop of the ink is used. Thus, the recovering measure (flushing operation or micro-vibrating operation) is conducted in such an operational condition that a normal recording operation can be achieved even when the small drop of the ink is used.

However, when the middle drop of the ink or the large drop of the ink is used for the recording operation, the ink is consumed so much that the normal recording operation can be achieved with less recovering operations. That is, the above uniform condition for the recovering measure may cause too many recovering operations, which means that the pressure-generating member may be driven in vain. That is, electric power may be consumed more and a lifetime of the pressure-generating member may be shortened. In addition, if a flushing operation is performed, the ink may be consumed in vain.

SUMMARY OF THE INVENTION

The object of this invention is to solve the above problems, that is, to provide a liquid jetting apparatus such as an ink-jet recording apparatus that can more efficiently conduct a maintenance (recovering) operation for preventing viscosity of ink in a nozzle from increasing in order to keep a condition for jetting a drop of the ink in good one.

In order to achieve the object, a liquid jetting apparatus includes: a head having a nozzle, a recovering unit that can recover a suitable viscosity of liquid in the nozzle from an increased viscosity thereof, a pressure-generating unit that can change a pressure of liquid in the nozzle in order to jet a drop of the liquid from the nozzle, based on jetting data, an obtaining unit that can obtain minimum-volume information of the drop of the liquid to be jetted from the nozzle by the pressure-generating unit, and a controller that can control the recovering unit, based on the minimum-volume information obtained by the obtaining unit.

According to the feature, since the recovering unit is controlled based on the minimum-volume information of the drop of the liquid to be jetted from the nozzle, a recovering operation for recovering the suitable viscosity of the liquid in the nozzle can be performed more efficiently, dependently on a state of the liquid in the nozzle.

If the head can move in a main scanning direction, preferably, the pressure-generating unit can jet a plurality of drops of the liquid having different volumes from the nozzle during one scanning movement, and the obtaining unit can obtain a least volume of the plurality of drops of the liquid to be jetted by the pressure-generating unit, as the minimum-volume information. In the case, a suitable recovering operation can be performed for each of the scanning movements.

Preferably, the obtaining unit is adapted to obtain the minimum-volume information of the drop of the liquid to be jetted from the nozzle, based on the jetting data. In the case, the minimum-volume information of the drop of the liquid can be obtained more easily.

Alternatively, the obtaining unit is adapted to obtain the minimum-volume information of the drop of the liquid, by measuring a least volume of the drop of the liquid actually jetted from the nozzle. In the case, the minimum-volume information of the drop of the liquid can be obtained more exactly.

Preferably, the controller is adapted to control the recovering unit, based on information about a kind of the liquid. In the case, an efficient recovering operation can be performed suitably for the kind of the liquid.

If the head is connected to a liquid cartridge that can supply the liquid to the head, the liquid cartridge is preferably provided with a kind-information storage that can store the information about the kind of the liquid in the liquid cartridge. In the case, the information about the kind of the liquid can be handled more easily.

In addition, preferably, the controller is adapted to control the recovering unit, based on an output from a sensor that can detect a state of environment where the liquid jetting apparatus is used. In the case, an efficient recovering operation can be performed suitably for the state of environment where the liquid jetting apparatus is used.

In addition, preferably, the controller is adapted to control the recovering unit, based on an output from a temperature sensor that can detect a temperature of the liquid in or near to the nozzle. In the case, an efficient recovering operation can be performed suitably for a state of the increased viscosity of the ink corresponding to a change of the temperature.

For example, the recovering unit is adapted to perform a micro-vibrating operation during which a meniscus of the liquid in the nozzle is caused to minutely vibrate. In the case, the controller may be adapted to change a number of micro-vibrations in the micro-vibrating operation performed by the recovering unit, based on the minimum-volume information obtained by the obtaining unit. Alternatively, the controller may be adapted to change a repeating cycle of the micro-vibrating operation performed by the recovering unit, based on the minimum-volume information obtained by the obtaining unit. Alternatively the controller may be adapted to change an amplitude the micro-vibrating operation performed by the recovering unit, based on the minimum-volume information obtained by the obtaining unit.

Alternatively the recovering unit is adapted to perform a flushing operation during which drops of the liquid in the nozzle having an increased viscosity are discharged. In the case, the controller may be adapted to change a number of the drops of the liquid discharged in the flushing operation performed by the recovering unit, based on the minimum-volume information obtained by the obtaining unit. Alternatively, the controller may be adapted to change a discharging period of the drops of the liquid discharged in the flushing operation performed by the recovering unit, based on the minimum-volume information obtained by the obtaining unit. Alternatively, the controller may be adapted to change a performing period of a plurality of flushing operations performed by the recovering unit, based on the minimum-volume information obtained by the obtaining unit.

In addition, a controlling unit for controlling a liquid jetting apparatus including: a head having a nozzle; a recovering unit that can recover a suitable viscosity of liquid in the nozzle from an increased viscosity thereof; a pressure-generating unit that can change a pressure of liquid in the nozzle in order to jet a drop of the liquid from the nozzle, based on jetting data; and an obtaining unit that can obtain minimum-volume information of the drop of the liquid to be jetted from the nozzle by the pressure-generating unit; is characterized by that the controlling unit comprises a controller that can control the recovering unit, based on the minimum-volume information obtained by the obtaining unit.

A computer system can materialize the whole controlling unit or only one or more components in the controlling unit.

This invention includes a storage unit capable of being read by a computer, storing a program for materializing the controlling unit in a computer system.

This invention also includes the program itself for materializing the controlling unit in the computer system.

This invention includes a storage unit capable of being read by a computer, storing a program including a command for controlling a second program executed by a computer system including a computer, the program is executed by the computer system to control the second program to materialize the controlling unit.

This invention also includes the program itself including the command for controlling the second program executed by the computer system including the computer, the program is executed by the computer system to control the second program to materialize the controlling unit.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

Figure 1:
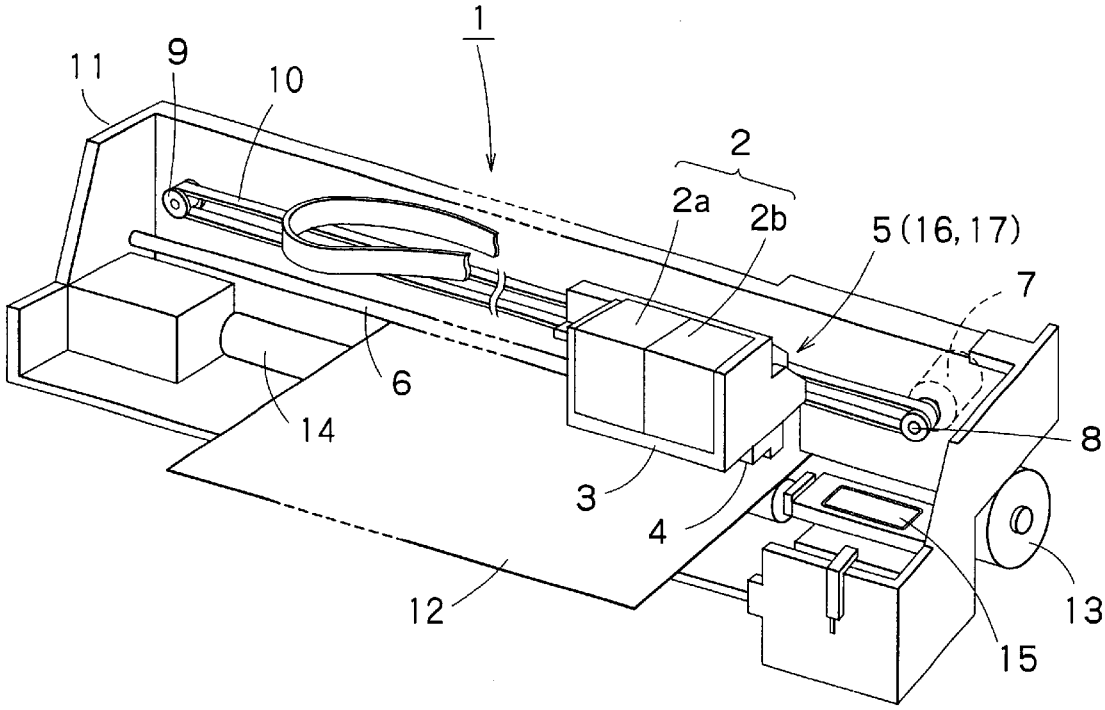
FIG. 1 is a schematic perspective view of an ink-jetting recording apparatus of an embodiment according to the invention.

FIG. 1 is a schematic perspective view of an ink-jetting printer 1 as a liquid jetting apparatus of a first embodiment according to the invention. The ink-jetting printer 1 includes a carriage 5, which has a cartridge holder 3 capable of holding a plurality of ink cartridges 2 and a recording head 4. The recording head 4 is fit for a color-recording operation. The carriage 5 is adapted to be reciprocated in a main scanning direction by a head-scanning mechanism.

A temperature sensor 16 and a humidity sensor 17 are mounted on the carriage 5 as sensors for detecting a state of environment where the ink-jetting printer 1 is used. The temperature sensor 16 can detect a temperature around the recording head 4. The humidity sensor 17 can detect humidity around the recording head 4. Concretely, the sensors 16 and 17 may be incorporated into a print board (not shown) for supplying necessary electric signals to piezoelectric vibrating members (see FIG. 3).

The head-scanning mechanism comprises: a guide bar 6 horizontally extending in a housing 11, a pulse motor (step motor) 7 arranged at a right portion of the housing, a driving pulley 8 connected to a rotational shaft of the pulse motor 7, a free pulley 9 mounted at a left portion of the housing, a timing belt 10 connected to the carriage 5 and going around the driving pulley 8 and the free pulley 9, and a printer controller 44 (see FIG. 4) for controlling the pulse motor 7. Thus, the carriage 5 i.e. the recording head 4 can be reciprocated in the main scanning direction i.e. in a width direction of a recording paper 12, by driving the pulse motor 7.

The printer 1 includes a paper feeding mechanism for feeding the recording paper 12 or any other recording medium in a feeding direction (sub-scanning direction). The paper feeding mechanism consists of a paper feeding motor 13, a paper feeding roller 14 or the like. The recording paper 12, which is an example of a recording medium, is fed in a subordinate scanning direction in turn by the paper feeding mechanism, in cooperation with the recording operation (main-scanning) of the recording head 4.

Figure 2:
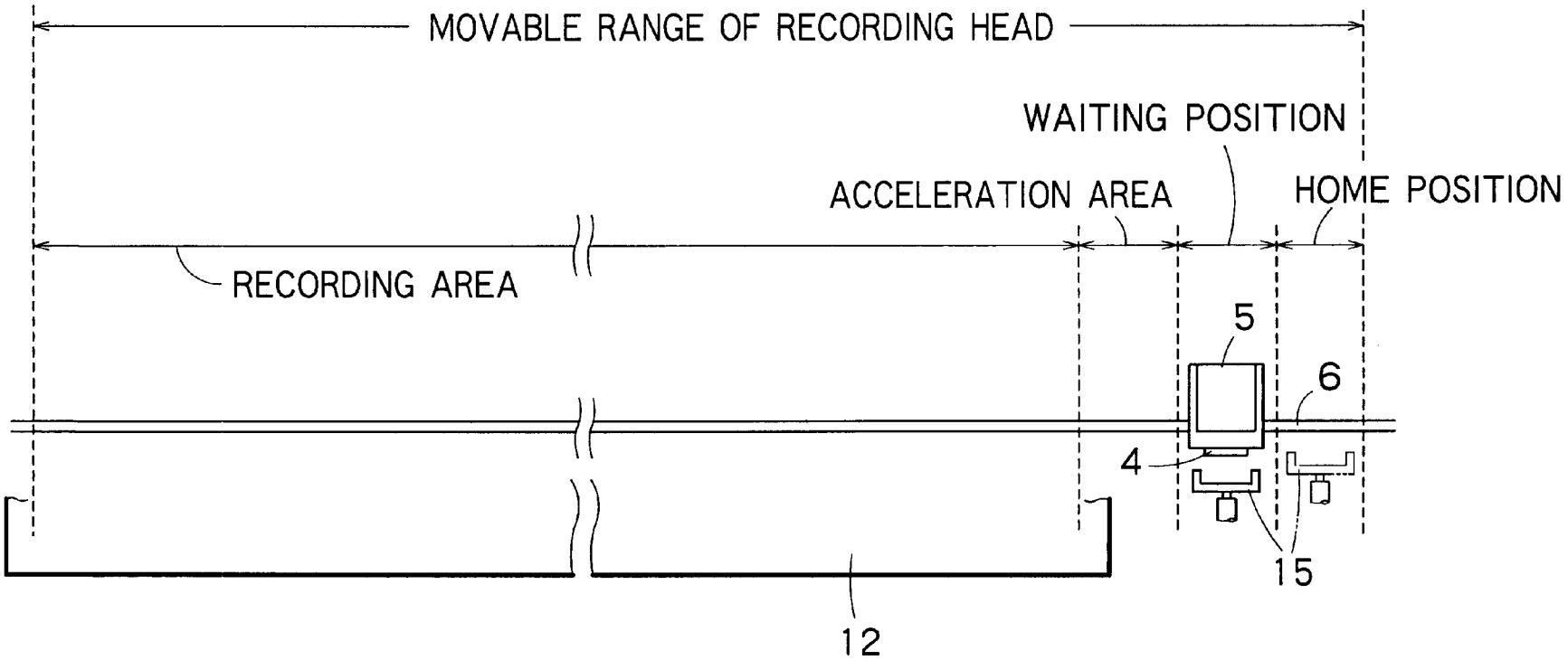
FIG. 2 is a schematic view for explaining a movable range of a recording head in a main scanning movement.

A home position and a waiting position of the recording head 4 (carriage 5) are set in a scanning range of the carriage 5 and in an end area outside an objective recording area. As shown in FIG. 2, the home position is set at an end portion (a right end portion in FIG. 2A) in the scanning range of the recording head 4. The waiting position is set substantially adjacently to the home position on a side of the objective recording area.

The home position is a position that the recording head 4 is moved to and stays at when electric power supply is of for when a long time has passed since the last recording operation. When the recording head 4 stays at the home position, a capping member 15 comes in contact with a nozzle plate 28 (see FIG. 3) and seals nozzles 25 (see FIG. 3). The capping member 15 is a tray-like member having a substantially square shape, being open upward, and made of an elastic material such as a rubber. A moistening material such as felt is attached inside the capping member 15. When the recording head 4 is sealed by the capping member 15, an inside of the capping member 15 is kept in high humid condition. Thus, it can be prevented that solvent of the ink evaporates from the nozzles 25.

The waiting position is a starting position for moving the recording head 4 in the main scanning direction. That is, normally, the recording head 4 stays and waits at the waiting position. When a recording operation is started, the recording head 4 is moved from the waiting position to the objective recording area. Then, when the recording operation is completed, the recording head 4 is moved back to the waiting position.

In addition, in the embodiment, an acceleration area is set between the waiting position and the objective recording area. The acceleration area is an area for raising a scanning velocity of the recording head 4 to a predetermined velocity.

Figure 3:
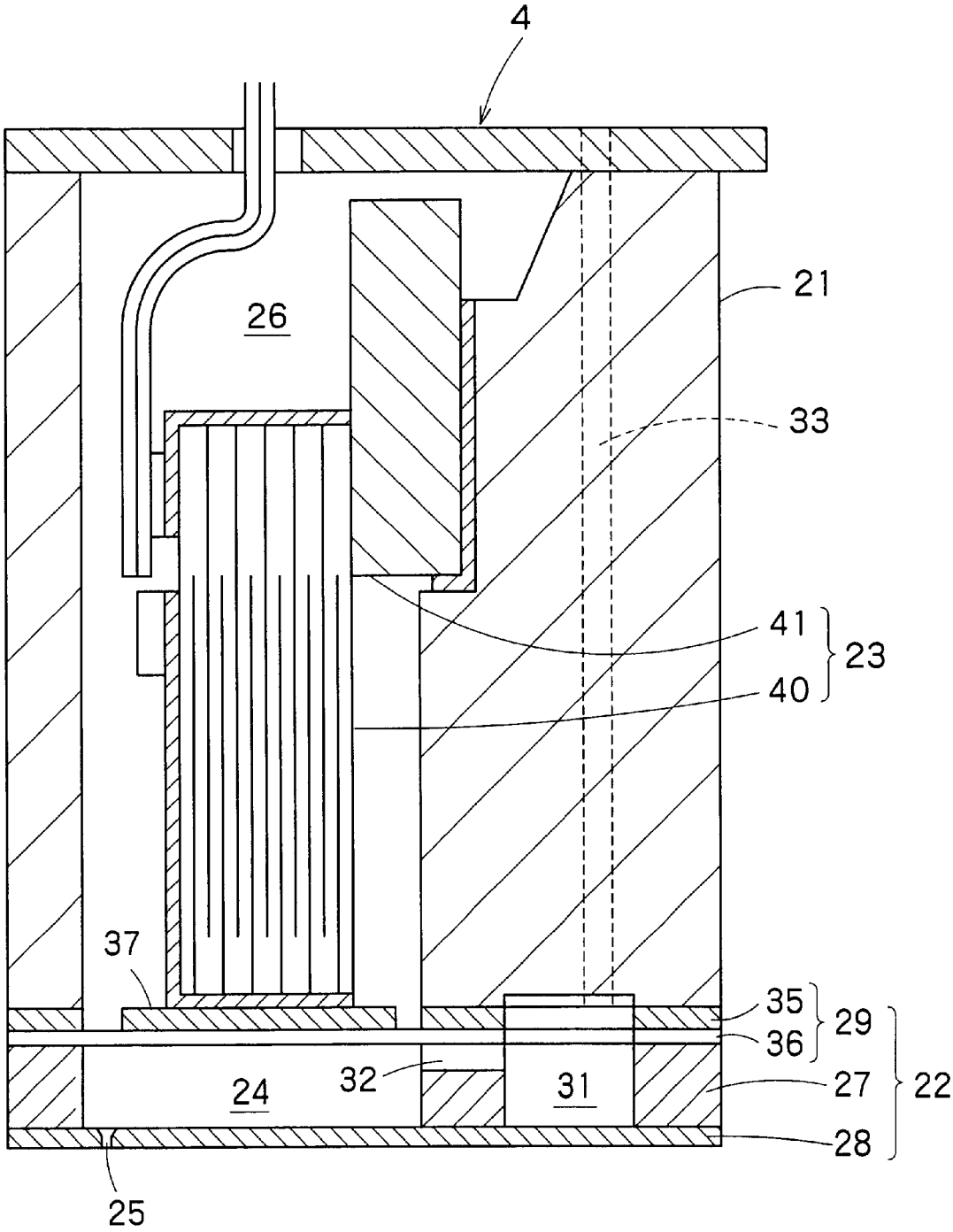
FIG. 3 is a sectional view of an example of a recording head.

Then, the recording head 4 is explained. As shown in FIG. 3, the recording head 4 mainly has a case 21 and an ink-way unit 22 joined to one surface of the case 21. Vibrating-member units 23 are accommodated in the case 21. Each of the vibrating-member units 23 is adapted to change pressure of ink in a pressure chamber 24 of the ink-way unit 22 in order to jet a drop of the ink from a nozzle 25 of the ink-way unit 22.

An accommodating room 26 is formed in the case 21 for accommodating the vibrating-units 23. For example, the case 21 is made of resin and shaped like a box. The accommodating room 26 formed in the case 21 is open at a side joined to the ink-way unit 22.

The ink-way unit 22 is formed by: a spacer 27, a nozzle plate 28 joined to one side surface of the spacer 27 and a vibrating plate 29 joined to the other side surface of the spacer 27. The spacer 27 is made of a silicon-wafer or the like. A predetermined pattern is formed on the spacer 27 by means of etching process. In the case, the predetermined pattern is a partition pattern forming: a plurality of pressure chambers 24 communicating with a plurality of nozzles 25 respectively, a common ink reservoir 31, and a plurality of ink-supplying ways 32 communicating with the common ink reservoir 31 and the plurality of pressure chambers 24 respectively. The common ink reservoir 31 is connected to an ink-supplying tube 33 via a connecting port. Thus, ink stored in the ink-cartridge 2 is adapted to be supplied into the common ink reservoir 31 through the connecting port.

A plurality of nozzles 25 are formed in the nozzle plate 28 in one or more rows at regular intervals corresponding to a density for forming dots. The rows of the plurality of nozzles 25 extend in the paper feeding direction i.e. in the sub-scanning direction.

The vibrating plate 29 is formed by laying an elastic film 36 such as a PPS film on a stainless plate 35. The stainless plate 35 is etched annularly for forming island portions 37, which correspond to the pressure chambers 24 respectively.

Each vibrating-member unit 23 is formed by a piezoelectric vibrating member 40 (a kind of pressure-generating unit) and a fixed board 41. The piezoelectric vibrating member 40 consists of alternatively stacked piezoelectric material and electric conductive layer, as shown in FIG. 3. The piezoelectric vibrating members 40 are arranged at regular intervals like teeth of a comb, correspondingly to each of the pressure chambers 24 of the ink-way unit 22. The piezoelectric vibrating members 40 may be formed from one board consisting of alternatively stacked piezoelectric material and electric conductive layer, by forming slits at the regular intervals therein. The fixed board 41 is fixed to a base end portion of the teeth-like piezoelectric vibrating members 40. The vibrating-member units 23 are inserted into the accommodating room 26 in such a manner that tip portions of the teeth-like piezoelectric vibrating members 40 faces the side joined to the ink-way unit 22. Then, the fixed board 41 is fixed to an inside wall of the accommodating room 26. Then, the tip portions of the teeth-like piezoelectric vibrating members 40 are joined to the island portions 37 of the vibrating plate 29, respectively.

Each piezoelectric vibrating member 40 can extend and contract in a longitudinal direction thereof, which is perpendicular to a stacked direction thereof, when a potential difference is applied between opposite electrodes. This moves a portion of the elastic film 36 (including a corresponding island portion 37) defining a corresponding pressure chamber 24. That is, when a piezoelectric vibrating member 40 extends in the longitudinal direction, the corresponding island portion 37 is pressed toward the nozzle plate 28. Thus, the portion of the elastic film 36 around the corresponding island portion 37 is deformed so that the corresponding pressure chamber 24 contracts. On the other hand, when a piezoelectric vibrating member 40 contracts in the longitudinal direction, the corresponding island portion 37 is pulled up to the accommodating room 26. Thus, the portion of the elastic film 36 around the corresponding island portion 37 is deformed so that the corresponding pressure chamber 24 expands. When the pressure chamber 24 expands and contacts, the pressure of the ink in the pressure chamber 24 may be changed. Thus, a drop of the ink can be jetted from the nozzle 25.

In the embodiment, the recording head 4 is formed for a color-recording operation wherein a plurality of different colors may be jetted. That is, the plurality of nozzles 25 are formed in the nozzle plate 28 in a plurality of rows (for example four rows), each of which rows extends in the sub-scanning direction. The pressure chambers 24, the vibrating-member units 23 or the like are arranged for the nozzles 25, respectively. In addition, a black-ink cartridge 2*a*, in which a black ink is stored, and a color-ink cartridge 2*b*, in which a yellow ink, a magenta ink and a cyan ink are separately stored, are mounted on the cartridge holder 3. Each of the inks is adapted to be jetted from the corresponding nozzles 25 for a printing operation.

Figure 4:
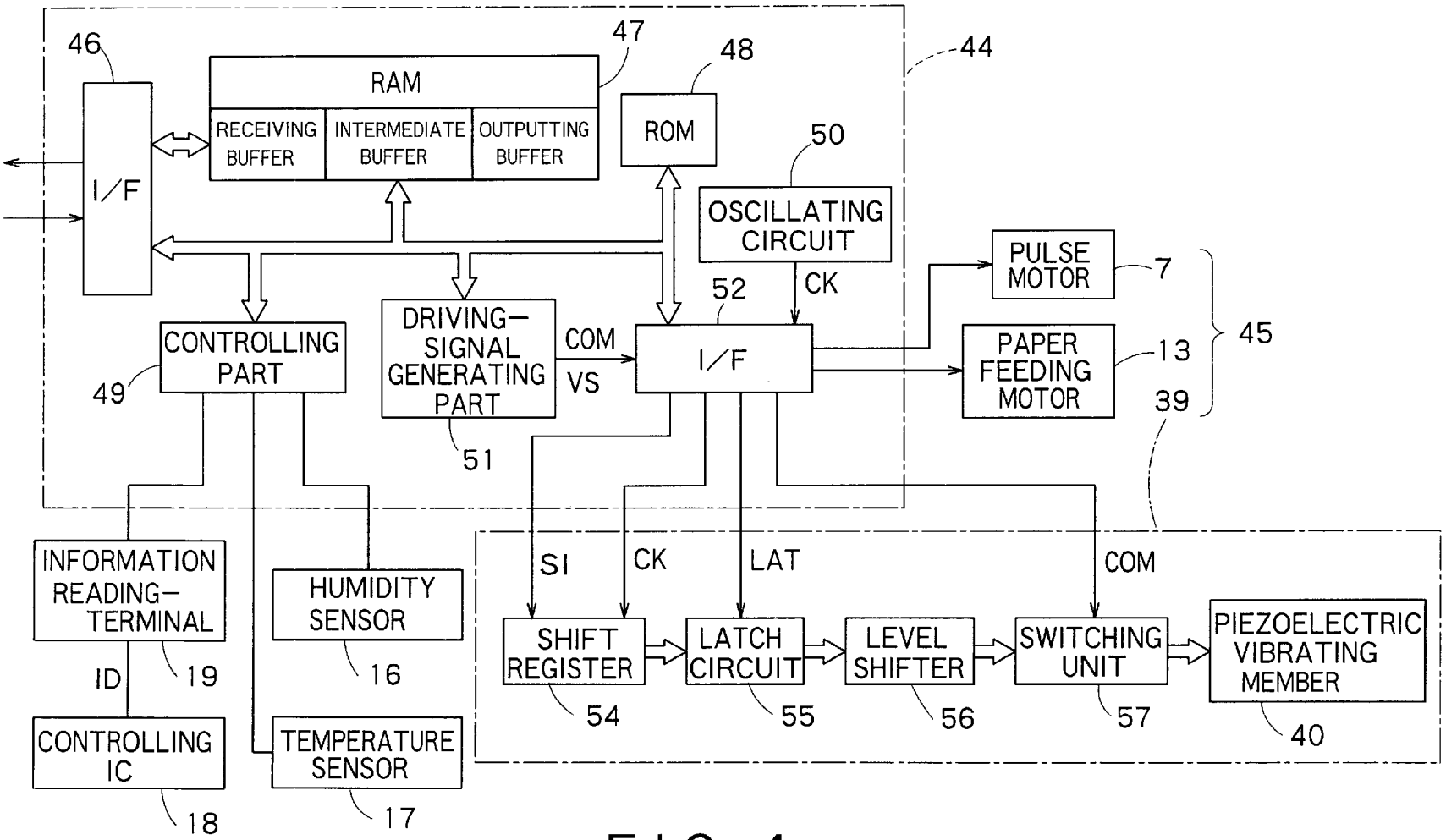
FIG. 4 is a schematic block diagram for explaining an electric structure for the recording head.

Each of the black-ink cartridge 2*a* and the color-ink cartridge 2*b* has a controlling IC 18 (see FIG. 4). The controlling IC 18 can function as a kind-information storing unit. That is, the controlling IC 18 can store ink-kind-information corresponding to a kind of the ink in the ink cartridge.

The ink-kind-information may be ID information showing a kind of colorant used in the ink and/or a color of the ink. For example, the controlling IC 18 of the black-ink cartridge 2*a* may store ID information showing "black dye" or "black pigments". In addition, the controlling IC 18 of the color-ink cartridge 2*b* may store ID information showing kinds of colorant, colors or the like of respective inks stored in respective blocks, such as "first block=yellow dye", "second block=magenta dye" and "third block=cyan dye".

The cartridge holder 3 has an information-reading terminal 19 (see FIG. 4) which is electrically connected to the controlling IC 18 when the ink cartridge 2 is attached on the cartridge holder 3. The information-reading terminal 19 can read out the ink-kind-information from the controlling IC 18. In addition, the information-reading terminal 19 is electrically connected to a controlling part 49 of the printer controller 44. Thus, the controlling part 49 can obtain the ink-kind-information (ID information) through the information-reading terminal 19.

Then, an electric structure of the printer 1 is explained. As shown in FIG. 4, the ink-jetting printer 1 has a printer controller 44 and a printing engine 45.

The printer controller 44 has: an outside interface (outside I/F) 46, a RAM 47 which is able to temporarily store various data, a ROM 48 which stores a controlling program or the like, a controlling part 49 including CPU or the like, an oscillating circuit 50 for generating a clock signal, a driving-signal generating part 51 for generating a driving signal COM and a micro-vibrating signal VS that are supplied to the piezoelectric vibrating members 40 of the recording head 4, and an inside interface (inside I/F) 52 that is adapted to send the driving signal COM, dot-pattern-data (bit-map-data) developed according to printing data (jetting data) or the like to the print engine 45.

The outside I/F 46 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 46.

The RAM 47 has a receiving buffer, an intermediate buffer, an outputting buffer and a work memory not shown. The receiving buffer is adapted to receive the printing data through the outside I/F 46, and temporarily store the printing data. The intermediate buffer is adapted to store intermediate-code-data converted from the printing data by the controlling part 49. The outputting buffer is adapted to store dot-pattern-data which are data for printing obtained by decoding (translating) the intermediate-code-data (for example, level data).

The ROM 48 stores font data, graphic functions or the like in addition to the controlling program (controlling routine) for carrying out various data-processing operations. The ROM 48 also stores various setting data for maintenance operations.

The controlling part 49 is adapted to develop the printing data received from the host computer or the like into the dot-patter-data i.e. control a recording operation, or control a micro-vibrating operation conducted for each of main scanning movements.

When the recording operation is controlled, the controlling part 49 reads out the printing data from the receiving buffer, converts the printing data into the intermediate-code-data, cause the intermediate buffer to store the intermediate-code-data. Then, the controlling part 49 analyzes the intermediate-code-data in the intermediate buffer and develops (decodes) the intermediate-code-data into the dot-pattern-data with reference to the font data and the graphic functions or the like stored in the ROM 48. Then, the controlling part 49 carries out necessary decorating operations to the dot-pattern-data, and thereafter causes the outputting buffer to store the dot-pattern-data.

Data for each dot in the dot-pattern-data consist of three bits (bit data). The three bits function as a selecting signal for selecting respective driving pulses DP1 to DP3 from the driving signal COM (see FIG. 5).

When the dot-pattern-data corresponding to one line recorded by one main scanning of the recording head 4 are obtained, the dot-pattern-data are outputted to an electric driving system 39 of the recording head 4 from the outputting buffer through the inside I/F 52 in turn. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 49 functions as an obtaining unit that can obtain minimum-volume information of the ink. In the case, the controlling part 49 can obtain a least volume (least-ink volume) of a plurality of drops of the ink to be jetted.

In the embodiment, the controlling part 49 is adapted to obtain the least-ink volume based on the above dot-pattern-data i.e. based on the bit data for dots forming one line. After the least-ink volume is obtained, the controlling part 49 functions as a controller that can control a recovering operation. In the embodiment, the controlling part 49 sets a most suitable condition for a micro-vibrating operation as a recovering operation, based on the obtained least-ink volume.

The driving-signal generating circuit 51 functions as a driving-signal generating unit, that is, generates a driving signal COM serially including a plurality of driving pulses in order to perform a recording operation with dots having different volumes. The driving signal COM is outputted to the electric driving system 39 of the recording head 4 through the inside I/F 52 during the recording operation.

Figure 5:
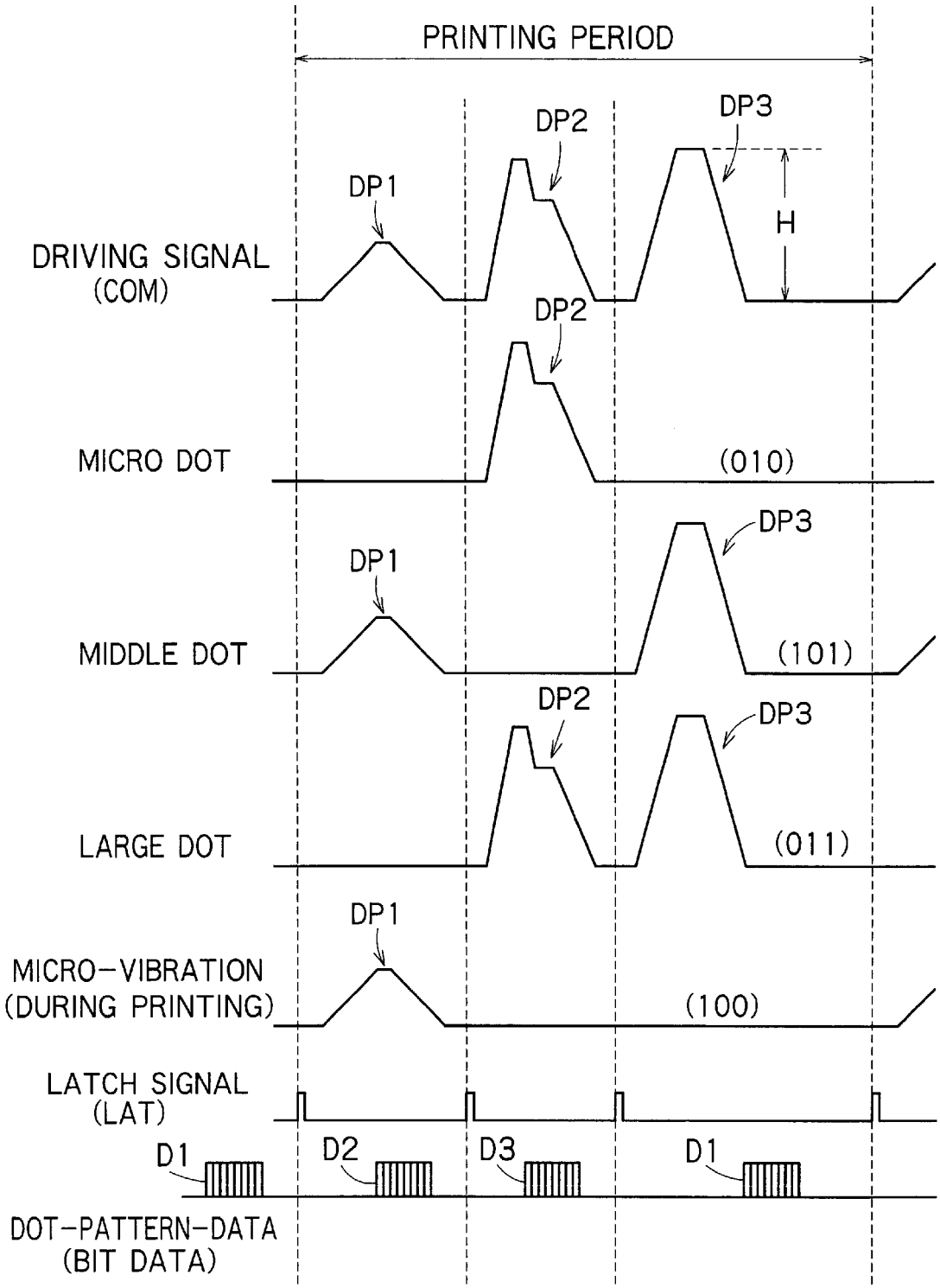
FIG. 5 is a graph for explaining an example of a relationship between a driving signal COM and driving pulses.

As shown in FIG. 5, the driving signal COM in the embodiment is a periodical signal according to a predetermined printing period T0. A first driving pulse DP1, a second driving pulse DP2 and a third driving pulse DP3 are connected in serial order and included in each period of the driving signal COM. The printing period TO is equal to a set time for recording one dot. In addition, the printing period T0 defines a basic timing for synchronization in the recording operation (main scanning movements). As described below, each of the driving pulses DP1, DP2 and DP3 in each printing period T0 is suitably selected and supplied to the piezoelectric vibrating member 40. Thus, a plurality of drops of the ink having different volumes can be jetted from the nozzles 25 of the recording head 4.

In addition, the driving-signal generating circuit 51 functions as a micro-vibrating-signal generating unit, that is, generates a micro-vibrating signal VS for performing a micro-vibrating operation. The micro-vibrating signal VS is outputted to the electric driving system 39 of the recording head 4 during the micro-vibrating operation for each of the main scanning movements.

Figure 6:
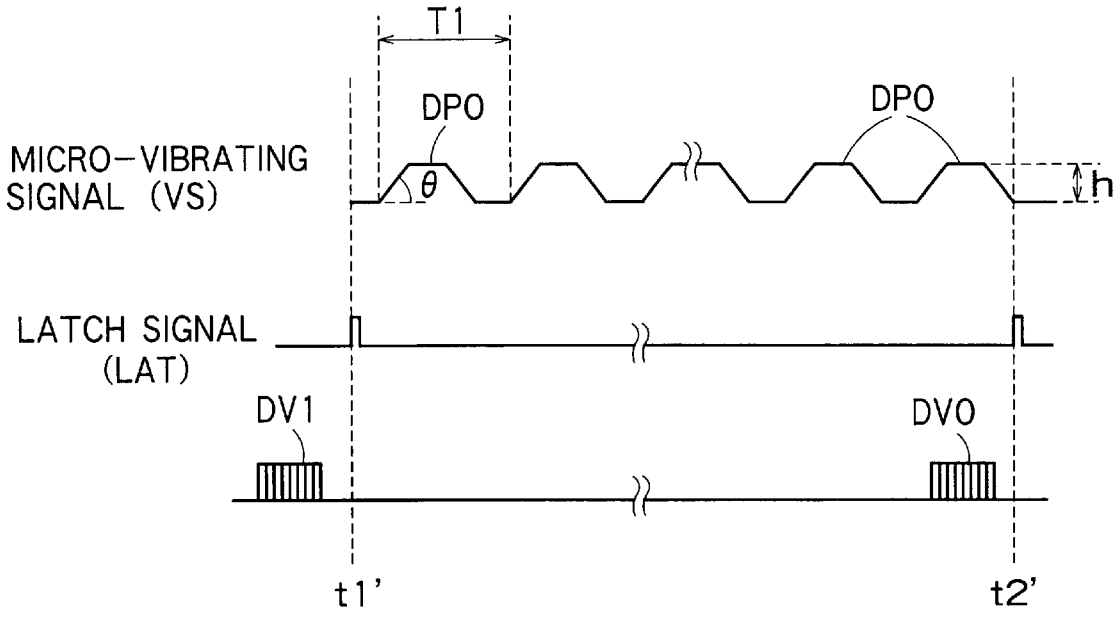
FIG. 6 is a graph for explaining an example of a micro-vibrating signal VS.

As shown in FIG. 6, the micro-vibrating signal VS in the embodiment is a periodical signal according to a variable period T1. A trapezoidal micro-vibrating pulse DP0 is included in each period of the micro-vibrating signal VS. The driving-signal generating circuit 51 is controlled by the controlling part 49 in order to generate a micro-vibrating signal VS including a micro-vibrating pulse DP0 of a most suitable amplitude h and according to a most suitable period T1.

In such a micro-vibrating signal VS, an amplitude h and a potential inclination θ of the micro-vibrating pulse DP0 are set in such a level that a drop of the ink can not be jetted. Thus, when such a potential difference is applied to the piezoelectric vibrating member 40, the pressure chamber 24 repeats to expand and contract so minutely that a meniscus of the ink in the nozzle 25 vibrates minutely. Thus, the ink in or near to the nozzle can be stirred, that is, a suitable viscosity of the ink can be recovered from an increased viscosity thereof.

The print engine 45 includes a paper feeding motor 13 as a paper feeding mechanism, a pulse motor 7 as a head scanning mechanism, and an electric driving system 9 of the recording head 4.

Then, the electric driving system 39 of the recording head 4 is explained. As shown in FIG. 4, the electric driving system 39 includes shift registers 54, latch circuits 55, level shifters 56 and switching units 57 and the piezoelectric vibrating members 40, which are electrically connected in the order. The shift registers 54 correspond to the respective teeth-like piezoelectric vibrating members 40 (the respective nozzles 25) of the recording head 4, respectively. Similarly, the latch circuits 55 correspond to the respective piezoelectric vibrating members 40, the level shifters 56 correspond to the respective piezoelectric vibrating members 40, and the switching units 57 correspond the respective piezoelectric vibrating members 40, respectively.

The recording head 4 can jet a plurality of drops of the ink having different volumes, based on the dot-pattern-data transmitted from the printer controller 44 to the electric driving system 39.

A dot-pattern-data (SI) is serially transmitted to a shift register 54 through the inside I/F 52, synchronously with the clock signal (CK) from the oscillating circuit 50. Each bit data (bit) of the serially transmitted dot-pattern-data is temporarily latched by a corresponding latch circuit 55. When the latched bit data is "1", the data is raised by a corresponding level shifter 56 as a voltage amplifier to a voltage that can drive a corresponding switching unit 57. The raised data is supplied to the switching unit 57. Then, the driving signal COM from the driving-signal generating circuit 51 is inputted to an input terminal of the switching unit 57. An output terminal of the switching unit 57 is connected to a corresponding piezoelectric vibrating member 40. Thus, while the bit data given to the switching unit 57 is "1", the driving signal COM generated from the driving-signal generating circuit 51 is supplied to the piezoelectric vibrating member 40. That is, the piezoelectric vibrating member 40 may be deformed based on the driving signal COM. On the other hand, while the bit data given to the switching unit 57 is "0", the driving signal COM is not supplied to the piezoelectric vibrating member 40.

In the embodiment, correspondingly to each of the three bit data (bits), each of the driving pulses DP1, DP2 and DP3 included in the driving signal COM can be selectively supplied to the piezoelectric vibrating member 40. That is, the uppermost bit D1 corresponds to the first driving pulse DP1, the second uppermost bit D2 corresponds to the second driving pulse DP2, and the lowermost bit D3 corresponds to the third driving pulse DP3. Thus, when the dot-pattern-data formed by the three bit data is transmitted to the recording head 4, each of the driving pulses DP1, DP2 and DP3 can be selectively supplied to the piezoelectric vibrating member 40.

For example, when a small drop of the ink (for example, about 3 pL) that can form a micro dot is jetted from a corresponding nozzle 25, the three bit data are set such that D1=0, D2=1 and D3=0. Then, only the second driving pulse DP2 is selected and supplied to the piezoelectric vibrating member 40. Similarly, when a middle drop of the ink (for example, about 6 pL) that can form a middle dot is jetted from the nozzle 25, the three bit data are set such that D1=1, D2=0 and D3=1. Then, only the first and third driving pulses DP1 and DP3 are selected and supplied to the piezoelectric vibrating member 40. Similarly, when a large drop of the ink (for example, about 13 pL) that can form a large dot is jetted from the nozzle 25, the three bit data are set such that D1=0, D2=1 and D3=1. Then, only the second and third driving pulses DP2 and DP3 are selected and supplied to the piezoelectric vibrating member 40. In addition, when a flushing operation is conducted during the printing operation, the three bit data are set such that D1=1, D2=0 and D3=0. Then, only the first driving pulse DP1 is selected and supplied to the piezoelectric vibrating member 40.

Then, the micro-vibrating operation conducted for each of main scanning movements is explained. The micro-vibrating operation is conducted before each printing operation for one line. In the case, the micro-vibrating operation is conducted in an acceleration area shown in FIG. 2.

In the micro-vibrating operation, the controlling part 49 refers to the dot-pattern-data for one line developed in the outputting buffer. Thus, the controlling part 49 obtains a volume of the smallest drop of the ink (least-ink volume) as the minimum-volume information, from one or more drops of the ink to be jetted during the printing operation for the one line. For example, when the printer 1 can jet three kinds of the drops of the ink, that is, a large drop of the ink, a middle drop of the ink and a small drop of the ink, the controlling part 49 judges what kind of the drop of the ink is the smallest drop of the ink during the printing operation for the one line. Owing to such a judgement, the controlling part 49 can obtain a volume of the smallest drop of the ink (least-ink volume).

In detail, when a dot-pattern-data for one line includes a bit data (010) for jetting a small drop of the ink, it is judged that the volume of the smallest drop of the ink (least-ink volume) for the one line is the volume of the small drop of the ink. Similarly, when a dot-pattern-data for one line is formed only by a bit data (011) for jetting a large drop of the ink and a bit data (101) for jetting a middle drop of the ink, it is judged that the volume of the smallest drop of the ink (least-ink volume) for the one line is the volume of the middle drop of the ink. In addition, when a dot-pattern-data for one line is formed only by a bit data (101) for jetting a middle drop of the ink, it is also judged that the volume of the smallest drop of the ink (least-ink volume) for the one line is the volume of the middle drop of the ink. Similarly, when a dot-pattern-data for one line is formed only by a bit data (011) for jetting a large drop of the ink, it is also judged that the volume of the smallest drop of the ink (least-ink volume) for the one line is the volume of the large drop of the ink.

After the controlling part 49 obtains the least-ink volume in the above manner, the controlling part 49 sets a condition for stirring the ink during the micro-vibrating operation.

Parameters of the condition for stirring the ink are: a number of supplies of the micro-vibrating pulse DP0, a repeating period T1 of the micro-vibrating pulse DP0 and an amplitude h of the micro-vibrating pulse DP0. For example, when the least-ink volume is the volume of the middle drop of the ink (standard condition), a number of supplies of the micro-vibrating pulse DP0 may be set to be 250 times, a repeating period T1 may set to be 46.3 micro second, and an amplitude h may be set to be 40% with respect to a maximum amplitude H of the driving signal COM (see FIG. 5).

When the least-ink volume is smaller than that in the above standard condition, the viscosity of the ink in or near to the nozzle tends to increase more than in the standard condition. Thus, the meniscus of the ink in the nozzle should be caused to vibrate greater and more times. For example, when the least-ink volume is the volume of the small drop of the ink, a number of supplies of the micro-vibrating pulse DP0 may be set to be 375 times, which is 1.5 times as many as that in the standard condition, a repeating period T1 may set to be 92.6 micro second, which is 2 times as many as that in the standard condition, and an amplitude h may be set to be 60% with respect to the maximum amplitude H of the driving signal COM.

It has been confirmed by experiments that the ink having an increased viscosity can be efficiently stirred by causing the meniscus to vibrate greater and more slowly when the least-ink volume is smaller than that in the above standard condition.

On the other hand, when the least-ink volume is larger than that in the above standard condition, the viscosity of the ink in or near to the nozzle tends to increase less than in the standard condition. Thus, a condition for stirring the ink is enough the same as the standard condition. Alternatively, it may be allowed that the meniscus of the ink in the nozzle vibrates only fewer times than in the standard condition. For example, when the least-ink volume is the volume of the large drop of the ink, a number of supplies of the micro-vibrating pulse DP0 may be suitably set in a range of 108 to 250 times.

After the condition for stirring the ink is set, the controlling part 49 supplies the micro-vibrating signal VS to the piezoelectric vibrating member 40.

Figure 7:
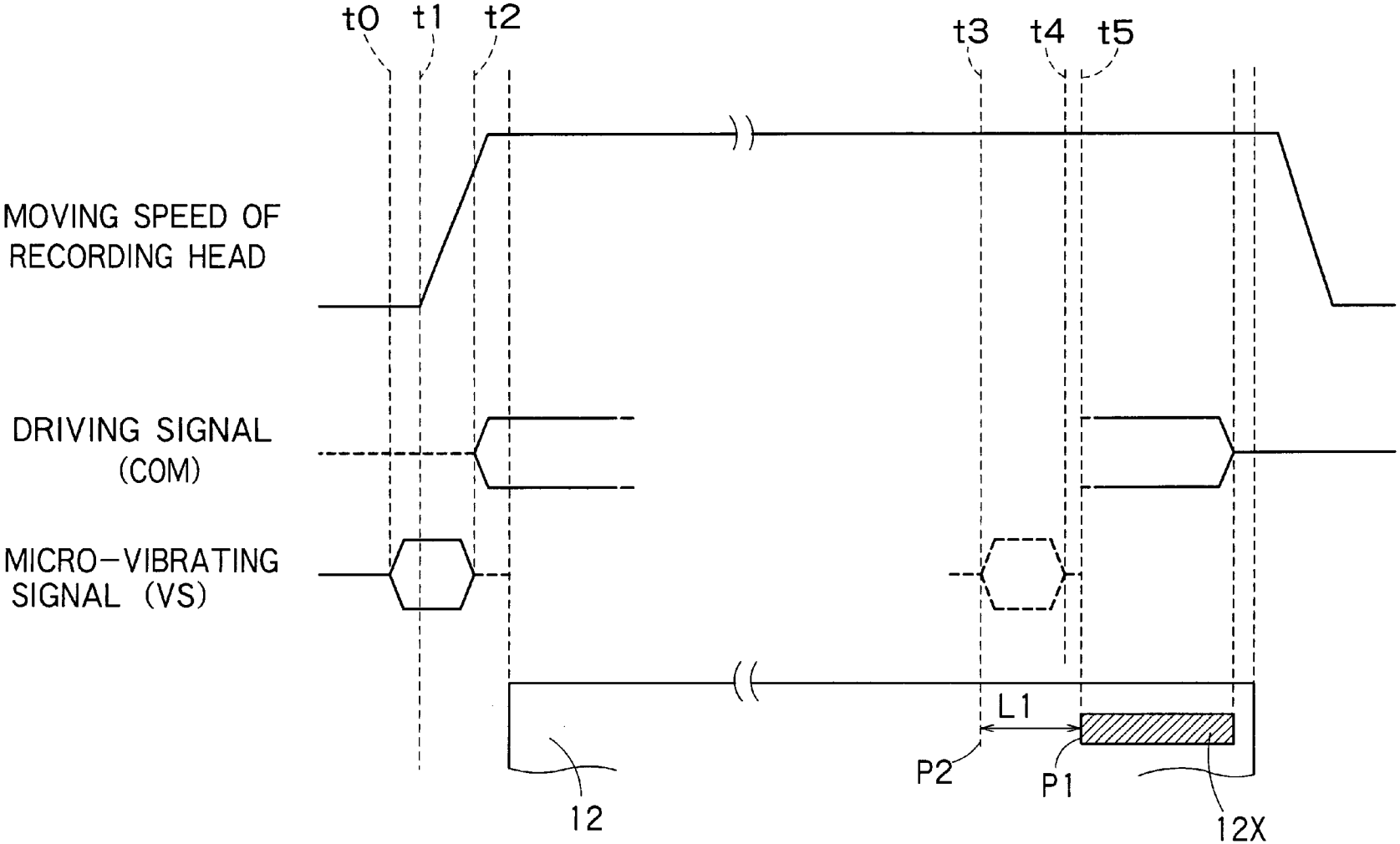
FIG. 7 is a schematic view for explaining a micro-vibrating operation.

As shown in FIG. 7, the controlling part 49 controls the driving-signal generating circuit 51 so that the driving-signal generating circuit 51 generates the micro-vibrating signal VS, wherein a repeating period T1 and an amplitude h of the micro-vibrating pulse DP0 has been set, from a point in time (t0) when the recording head 4 stays at the waiting position. Then, the controlling part 49 sets a bit data DV1 being "1" to the shift registers 54 for all of the piezoelectric vibrating members 40 (see FIG. 6). After the bit data DV1 is set, the controlling part 49 outputs a latch signal (LAT) to the latch circuits 55 in order to cause the latch circuits 55 to latch the bit data DV1 (t1': see FIG. 6). When the bit data DV1 is latched, the micro-vibrating signal VS is supplied to all of the piezoelectric vibrating members 40. Thus, all of the meniscuses of the ink in the nozzles 25 start to minutely vibrate. Then, after the bit data DV1 is latched, the controlling part 49 sets a bit data DV0 being "0" to the shift registers 54 for all of the piezoelectric vibrating members 40 (see FIG. 6).

In addition, the controlling part 49 drives the pulse motor 7 in order to start to move the recording head 4 (carriage 5) in the main scanning direction (t1). Then, as shown in FIG. 6, when the set number of micro-vibrating pulses DP0 are supplied to the piezoelectric vibrating members 40, the controlling part 49 outputs a latch signal (LAT) to the latch circuits 55 in order to cause the latch circuits 55 to latch the bit data DV0 at that timing (t2'). When the bit data DV0 is latched, the supply of the micro-vibrating signal VS to the piezoelectric vibrating members 40 is stopped. After that, at a timing (t2) just before a scanning speed of the recording head 4 reaches a predetermined speed, the controlling part 49 controls the driving-signal generating circuit 51 so that the driving-signal generating circuit 51 stops generating the micro-vibrating signal VS but generates the driving signal COM.

As described above, in the micro-vibrating operation, a waveform of the micro-vibrating signal VS is determined most suitably (optimized) based on the volume of the smallest drop of the ink (least-ink volume) during the one main scanning movement. Thus, the ink may be stirred sufficiently and not excessively. Thus, while a condition of the ink in or near to the nozzle can be kept in good one, useless micro-vibrating operations can be prevented. Thus, electric power may be consumed less and lifetimes of the pressure-generating members 40 may be extended.

As described above, the tendency for the viscosity of the ink to increase may be changed dependently on the volume of the drop of the ink jetted from the nozzle i.e. the consumed volume of the ink. However, the tendency may be also changed dependently on temperature and/or humidity of environment where the printer 1 is disposed, in particular, on temperature and/or humidity of environment around the recording head 4. In addition, the tendency may be also changed dependently on a kind of the ink.

Thus, in addition to the least-ink volume, information about the temperature of the environment, information about the humidity of the environment, and information about the kind of the ink can be obtained and taken into account in order to set (optimize) a condition for stirring the ink. In the case, the micro-vibrating operation can be performed in a more suitable stirring condition.

In the embodiment, the controlling part 49 can obtain the temperature of the environment around the recording head 4 as an environmental temperature (a kind of a state of the environment), based on information from the temperature sensor 16. If the environmental temperature is higher than a standard temperature (for example, room temperature), the condition for stirring the ink determined based on the least-ink volume may be modified. For example, the number of supplies of the micro-vibrating pulses DP0 may be increased and/or the repeating period T1 of the micro-vibrating pulses DP0 may be extended. On the contrary, if the environmental temperature is lower than the standard temperature, the condition for stirring the ink determined based on the least-ink volume may not be modified. Such a modification is controlled by the controlling part 49 based on a judgement that a higher environmental temperature corresponds to a higher tendency for the viscosity of the ink to increase and that a lower environmental temperature corresponds to a lower tendency for the viscosity of the ink to increase.

Substantially similarly, the controlling part 49 can obtain the humidity of the environment around the recording head 4 as an environmental humidity (a kind of a state of the environment), based on information from the humidity sensor 17. If the environmental humidity is lower than a standard humidity, the condition for stirring the ink determined based on the least-ink volume may be modified. For example, the number of supplies of the micro-vibrating pulses DP0 may be increased and/or the repeating period T1 of the micro-vibrating pulses DP0 may be extended. On the contrary, if the environmental humidity is higher than the standard temperature, the condition for stirring the ink determined based on the least-ink volume may not be modified. Such a modification is controlled by the controlling part 49 based on a judgement that a lower environmental humidity corresponds to a higher tendency for the viscosity of the ink to increase and that a higher environmental humidity corresponds to a lower tendency for the viscosity of the ink to increase.

In addition, the controlling part 49 can obtain the information about the kind of the ink (ink-kind-information) that is stored in the controlling IC 18 mounted in the ink cartridge 2. In general, viscosity of ink including pigments as colorant tends to increase more than that of ink including dye as colorant. In addition, among a plurality of inks including pigments or a plurality of inks including dye, a black ink tends to increase more than a deep color ink such as a cyan ink and a magenta ink. Then, the deep color ink tends to increase more than a light color ink such as a yellow ink, a light cyan ink and a light magenta ink. Thus, it is preferable that the tendency for the viscosity of the ink to increase is judged based on each kind of the ink (ID information). For example, a kind of the ink has a higher tendency for the viscosity of the ink to increase, the number of supplies of the micro-vibrating pulses DP0 may be increased, the repeating period T1 of the micro-vibrating pulses DP0 may be extended, and/or the amplitude h of the micro-vibrating pulses DP0 may be enlarged.

As described above, if the condition of stirring the ink is optimized based on the temperature and the humidity of the environment and/or the kind of the ink, the micro-vibrating operation may be performed more efficiently. Thus, the electric power may be consumed much less and the lifetimes of the pressure-generating members 40 may be extended more.

This invention is not limited by the above embodiment, but could be variously modified in a scope of appended claims.

For example, this invention can be applied to a prior-printing micro-vibrating operation, which is performed just before actually jetting a drop of the ink in a printing operation. In the case, the controlling part 49 refers to the dot-pattern-data for one line developed in the outputting buffer. Thus, the controlling part 49 obtains a recording-starting point (for example, a point P1 shown in FIG. 7) where a drop of the ink is first jetted in the main scanning movement for the one line. Then, a point P2 back by a predetermined distance L1 from the recording-starting Pi point to the waiting position is obtained (calculated) as a micro-vibrating-starting point. Then, when the recording head 4 reaches the micro-vibrating-starting point P2, a prior-printing micro-vibrating operation is performed according to a condition for stirring the ink optimized in the sane way as described above. In the case, since the micro-vibrating operation is performed just before actually jetting a drop of the ink, it may be more surely prevented that the viscosity of the ink increases.

In addition, in the above embodiment, the controlling part 49 determines a condition for stirring the ink based on whether a small drop of the ink for forming a small dot is jetted in the one line. However, the controlling part 49 may determine a condition for stirring the ink based on a ratio of one or more small drops of the ink jetted in the one line. For example, a ratio of the small drops of the ink with respect to all of the drops of the ink jetted in the one main scanning movement can be obtained from the dot-pattern-data. If the ratio is higher than a standard value, it may be judged that the viscosity of the ink tends to increase. Thus, the number of supplies of the micro-vibrating pulses DP0 may be increased, the repeating period T1 of the micro-vibrating pulses DP0 may be extended, and/or the amplitude h of the micro-vibrating pulses DP0 may be enlarged. On the contrary, if the ratio is lower than the standard value, it may be judged that the viscosity of the ink tends not to increase. Thus, the number of supplies of the micro-vibrating pulses DP0 may be decreased.

In addition, in the above embodiment, a condition for stirring the ink is determined based on a dot-pattern-data for a current main scanning movement. However, a micro-vibrating operation (including a prior-printing micro-vibrating operation) for a current main scanning movement may be controlled based on information about drops of the ink jetted during the previous main scanning movement. In the case, a least-ink volume in the previous main scanning movement can be obtained based on a dot-pattern-data for the previous main scanning movement or by measuring an actually jetted volume of the ink.

In addition, the pressure-generating unit that can change the pressure of the ink in the pressure chamber 24 maybe a heating member or a magnetostrictive device, instead of the piezoelectric vibrating member 40.

In the above embodiment, the micro-vibrating operation is performed as a recovering operation for recovering a suitable viscosity of ink in the nozzle from an increased viscosity thereof. However, the recovering operation may be a flushing operation instead of the micro-vibrating operation.

Figure 8:
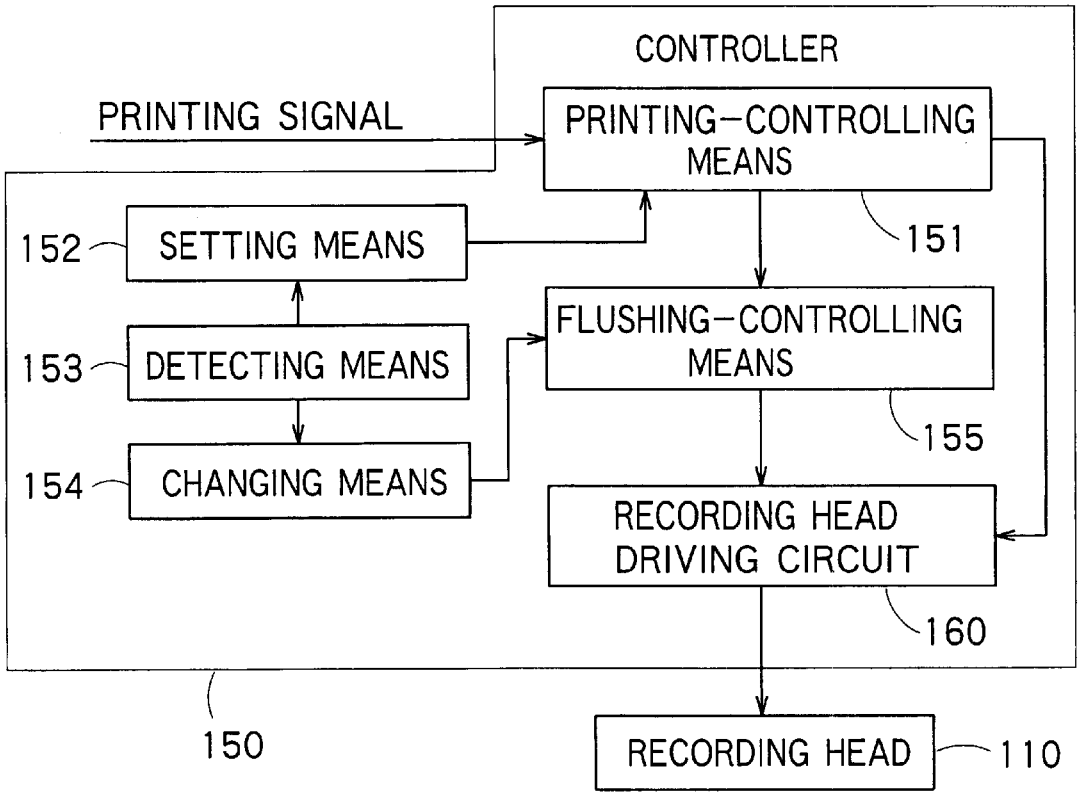
FIG. 8 is a schematic block diagram of an ink-jetting recording apparatus of another embodiment according to the invention.

FIG. 8 shows a schematic block diagram of an ink-jetting recording apparatus than can perform a flushing operation. As shown in FIG. 8, the ink-jetting recording apparatus comprise a recording head 110 for actually performing a printing operation and a controller 150 for controlling the recording head 110.

Printing-controlling means 151 in the controller 150 can control the printing operation of the recording head 110. For example, according to an input of a printing signal, the printing-controlling means 151 causes the recording head 110 to perform the printing operation through a recording-head driving circuit 160.

Setting means 152 can set a printing condition including resolution (fineness) of the printing operation and a smallest volume of drops of the ink that is to be jetted from a nozzle. For example, the ink-jetting apparatus of the embodiment has a speed-priority mode wherein priority is given to a speed of the printing operation, and a quality-priority mode wherein priority is given to a quality of images printed by the printing operation. In the case, the setting means 152 can change the printing condition according to a selected mode.

In the speed-priority mode of the embodiment, the resolution is 360×360 dpi, the smallest volume of the drop of the ink is 13.3 pL, that is, relatively large. On the other hand, in the quality-priority mode, the resolution is 720×720 dpi or more, the smallest volume of the drop of the ink is 3 pL, that is, relatively small.

Figure 9A:
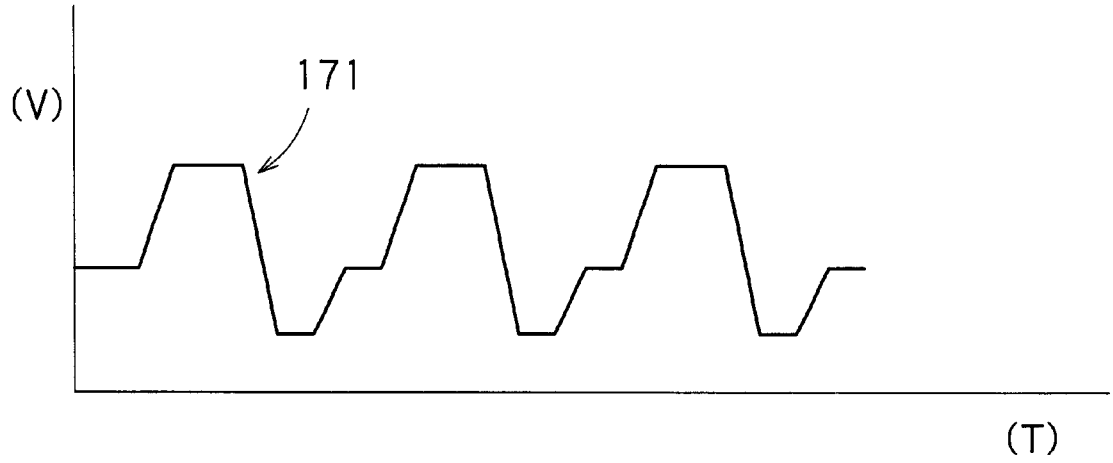
FIGS. 9A and 9B are graphs for explaining waveforms of pulses for jetting ink, in the ink-jetting recording apparatus shown in FIG. 8.

In detail, in the speed-priority mode, as shown in FIG. 9A, a jetted volume of a drop of the ink may be changed by the number of one type of waveforms. That is, a volume 13.3 pL of the drop of the ink is jetted by one waveform 171. A volume 26.6 pL of the drop of the ink is jetted by two waveforms 171. In addition, a volume 39.9 pL of the drop of the ink is jetted by three waveforms 171. Thus, three levels of dots can be achieved.

Figure 9B:
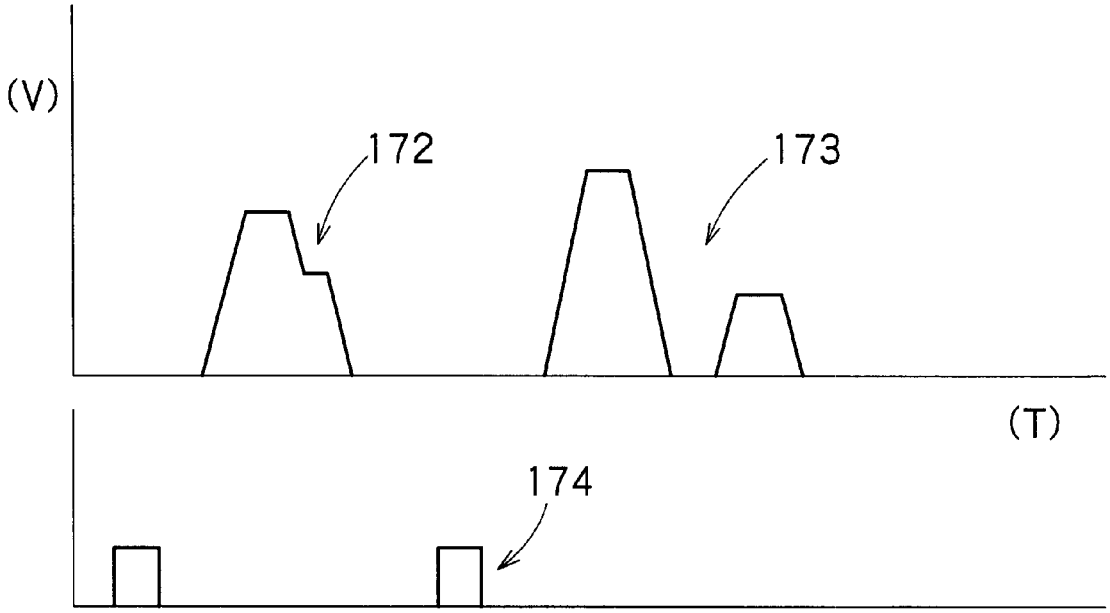

On the other hand, in the quality-priority mode, in order to achieve a finer printing, as shown in FIG. 9B, a jetted volume of a drop of the ink may be changed by combinations of two types of waveforms. That is, a volume 3 pL of the drop of the ink is jetted by a first waveform 172. A volume 10 pL of the drop of the ink is jetted by a second waveforms 173. In addition, a volume 20 pL of the drop of the ink is jetted by a series of the first and second waveforms 172 and 173. The combinations of the first and second waveforms 172 and 173 may be controlled by a latch signal 74. Thus, three levels of dots can be achieved. Herein, FIG. 9B shows a waveform formed by the first and second waveforms 172 and 173 for jetting a volume 20 pL of the drop of the ink.

Figure 10:
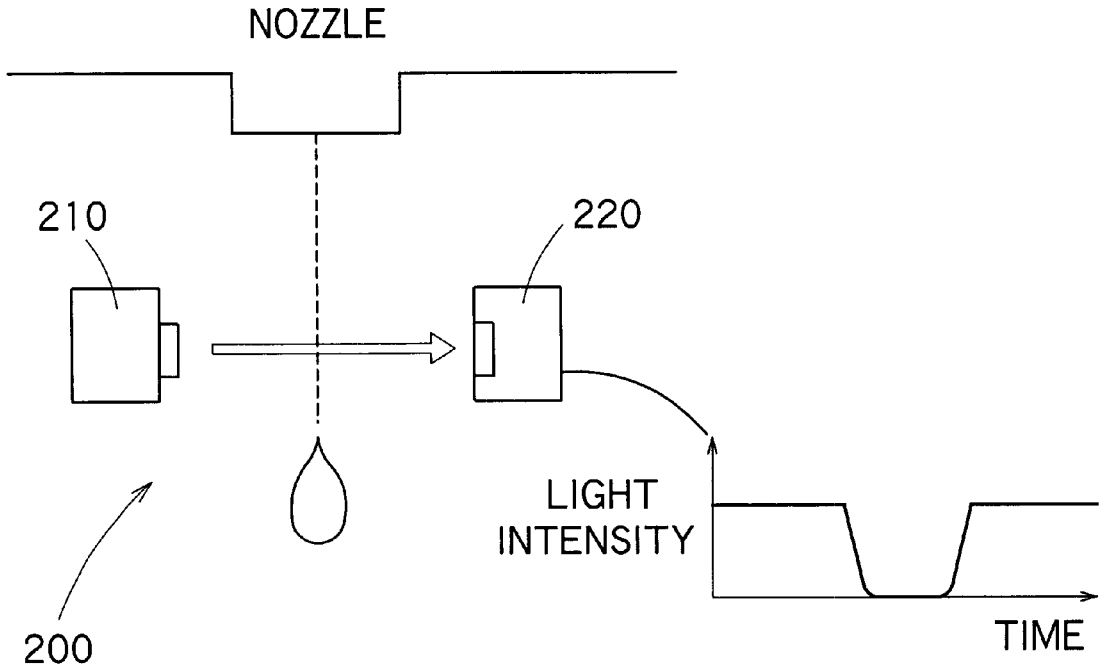
FIG. 10 is a schematic view of an example of a beam sensor.

In addition, detecting means 153 can detect (obtain) a least volume (least-ink volume) from a plurality of drops of the ink to be jetted from the nozzle. For example, in the embodiment, the least volume that has been set by the setting means 152 is detected. The detailed detecting manner is not limited. For example, the least volume may be detected by measuring an actually jetted volume of a drop of the ink. For example, as shown in FIG. 10, the actually jetted volume of the drop of the ink can be measured by using a beam that can be interrupted by the actually jetted ink. In a beam sensor shown in FIG. 10, when a beam from a light-emitting device 210 is interrupted by the drop of the ink, a light-receiving device 220 generates a pulse. Then, a width of the pulse depends on the volume of the drop of the ink. Thus, the volume of the drop of the ink can be measured based on the width of the pulse.

Changing means 154 can change a control condition for the flushing operations, based on a result detected by the detecting means 153. In the embodiment, the changing means 154 can change a number of times that a drop of the ink is jetted during one flushing operation, a jetting period of the drops of the ink during one flushing operation and/or an interval (period) between any two successive flushing operations.

In the embodiment, as shown in Table.1, in the quality-priority mode wherein the smallest volume of the ink is relatively small, the control condition is set in such a manner that: the number of jettings of drops of the ink during one flushing operation is larger, the jetting period of the drops of the ink during one flushing operation is shorter and the interval (period) between any two successive flushing operations is shorter, with respect to the speed-priority mode wherein the smallest volume of the ink is relatively large. That is, when the smallest volume of the ink is smaller, the number of jettings of drops of the ink during one flushing operation is larger and the interval (period) between any two successive flushing operations is shorter, in order to increase jetted volume of the ink. In addition, when the smallest volume of the ink is smaller, the jetting period of the drops of the ink during one flushing operation is shorter, in order to stabilize jetting the drops of the ink.

TABLE 1

| Mode | Least Volume of Drop of Ink (PL) | Number of Jettings of Drops of Ink During one Flushing Operation (shot) | Jetting Period of Drops of Ink During one Flushing Operation (kHz) | performing Period of Flushing Operations (time/sec) |
|---|---|---|---|---|
| Speed-Priority | 13.3 | 72 | 10.8 | 1/12 |
| Quality-Priority | 3.0 | 120 | 3.6 | 1/8 |

In addition, flushing-controlling means 155 can cause the recording head 110 to perform the flushing operation, based on the control condition changed by the changing means 154, through the recording-head driving circuit 160.

As shown in Table.1, in the speed-priority mode of the embodiment, since the least volume of the drop of the ink is 13.3 pL i.e. relatively large, a smaller number of jettings of the drops of the ink is sufficient to recover a suitable viscosity of ink in the nozzle. On the other hand, in the quality-priority mode of the embodiment, since the least volume of the drop of the ink is 3 pL i.e. relatively small, a larger number of jettings of the drops of the ink is necessary to recover a suitable viscosity of ink in the nozzle. Thus, the number of jettings of the drops of the ink is increased by the changing means 154. In the Table.1, "period of performing flushing operations" is 1/12 (time/second) means that the flushing operations are performed every 12 seconds.

As described above, in the embodiment, the changing means 154 can change the control condition for the flushing operations, based on the least volume of the drop of the ink detected by the detecting means 153. Thus, regardless of the volume of the drop of the ink to be jetted, the flushing operation can always and surely recover a suitable viscosity of the ink from an increased viscosity thereof. Thus, the drop of the ink can be jetted properly even just after the printing operation is started. In addition, it can be prevented that the nozzle is clogged with the ink having an increased viscosity.

Figure 11:
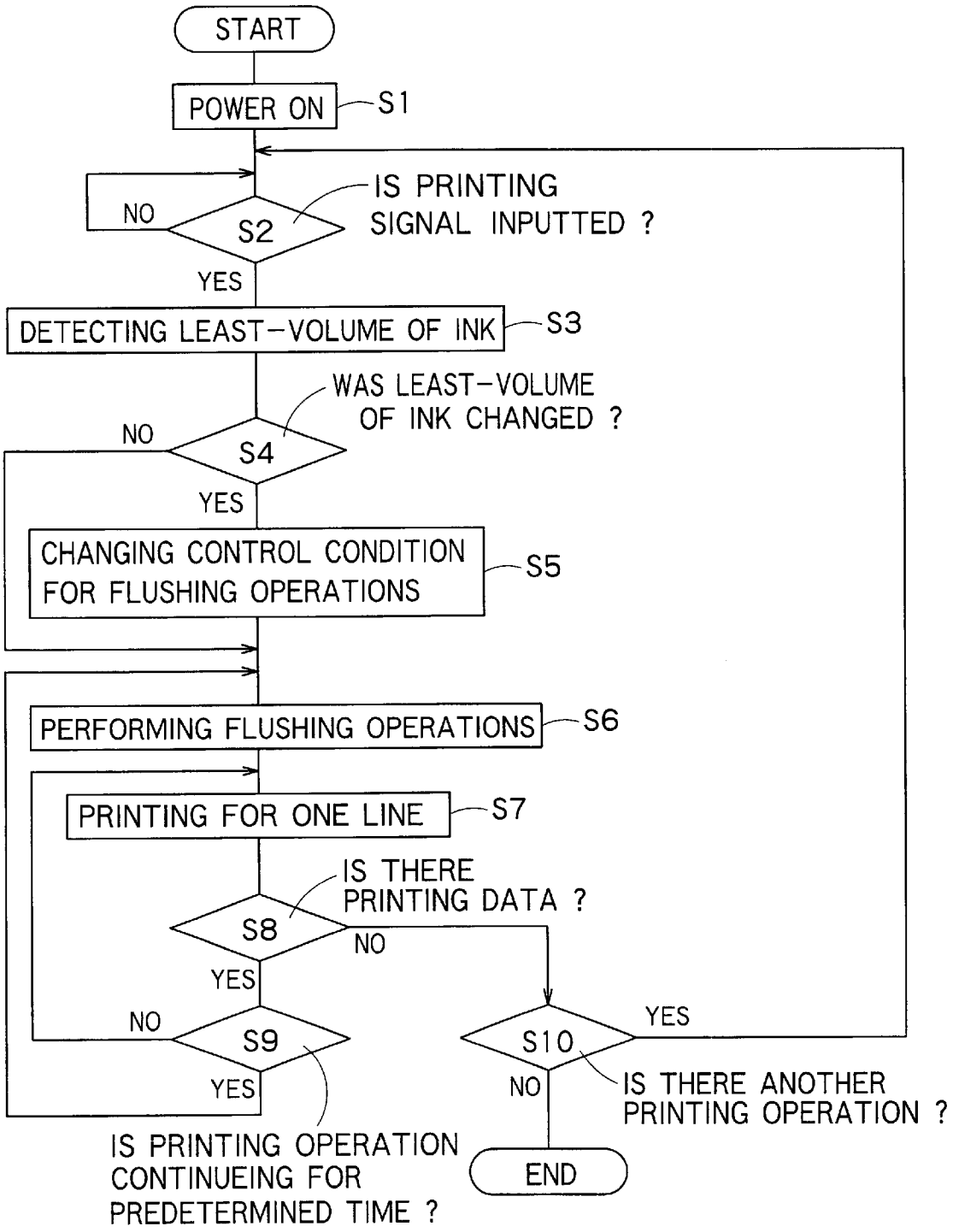
FIG. 11 is a flow chart for explaining an operation of the ink-jetting recording apparatus shown in FIG. 8.

Then, with reference to a flow chart shown in FIG. 11, an operation of the ink-jetting recording apparatus of the embodiment is explained.

As shown in FIG. 11, when electric power is supplied to the apparatus (S1) and a printing signal is inputted thereto (S2), the detecting means 153 detects a least volume from drops of the ink (S3). Then, if the detected least volume is different from the previous least volume (S4), the changing means 154 changes a condition for a flushing operations, based on the result detected by the detecting means 153 (S5). Then, the flushing-controlling means 155 cause the recording head 110 to perform the flushing operation via the recording-head driving circuit 160 (S6). Then, the printing-controlling means 151 cause the recording head 110 to move in a main scanning direction by one path and perform a printing operation via the recording-head driving circuit 160 (S7). When there remain still one or more printing data (S8), the printing-controlling means 151 judges whether the printing operation has been performed for a predetermined time after the latest flushing operation (S9). If the printing operation has not been performed for the predetermined time yet, the operation goes back to the step S7. That is, the recording head 110 is caused to move by one path and perform the printing operation. If the printing operation has already been performed for the predetermined time, the operation goes back to the step S6. That is, the flushing-controlling means 155 cause the recording head 110 to perform the flushing operation again. Then, the steps S6 to S9 are repeated. When there remain no printing data at the step S8, that is, when the printing operation is completed, it is judged whether there is another printing operation (S10). If there is another printing operation, the operation goes back to the step 2. If there is no printing operation, the entire printing operations are completed.

In the flow shown in FIG. 11, the intervals for performing the flushing operations are controlled by the printing time. However, the intervals may be controlled by printing lines or the like.

Figure 12:
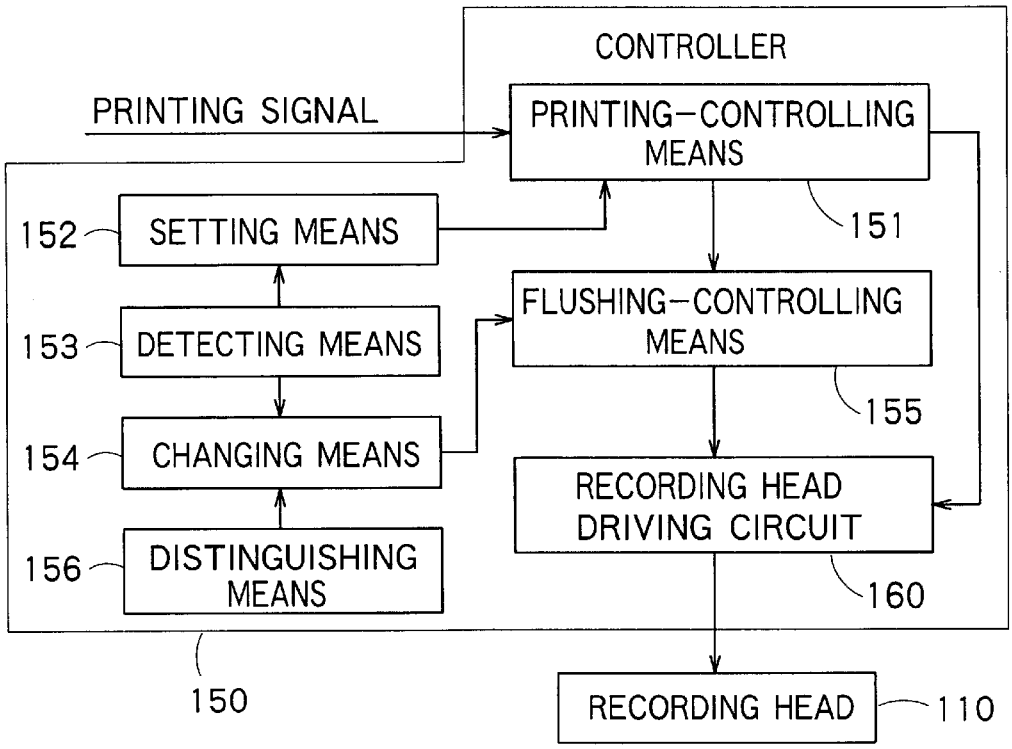
FIG. 12 is a schematic block diagram of an ink-jetting recording apparatus of another embodiment according to the invention.

FIG. 12 is a schematic block diagram of an ink-jetting recording apparatus of another embodiment.

The ink-jetting recording apparatus of the embodiment is provided with distinguishing means 156 that can distinguish a kind of the ink, for example ink including dye or ink including pigments, in addition to the structure of the embodiment shown in FIG. 8. In the case, the changing means 154 is adapted to change the control condition for the flushing operations based on the result detected by the detecting means 153 and a result distinguished by the distinguishing means 156. Another structure is the same as the embodiment shown in FIG. 8.

A detailed manner of the distinguishing means 156 is not limited. For example, the distinguishing means 156 can detect ink-kind-information from an IC substrate or the like mounted on an ink cartridge.

For example, when the ink includes dye as colorant, the nozzle tends not to be clogged with the ink relatively. On the contrary, when the ink includes pigments as colorant, the nozzle tends to be clogged with the ink. That is, the tendency for the nozzle to be clogged with the ink depends on the kind of the ink. In the embodiment, since the changing means 154 changes the control condition for the flushing operations based on the result detected by the detecting means 153 and the result distinguished by the distinguishing means 156, whatever the kind of the ink is, it can be surely prevented that the nozzle is clogged with the ink. Examples of control conditions for the flushing operations are shown in Table.2.

TABLE 2

| Kind of Ink | Mode | Least Volume of Drop of Ink (PL) | Number of Jettings of Drops of Ink During one Flushing Operation (shot) | Jetting Period of Drops of Ink During one Flushing Operation (kHz) | performing Period of Flushing Operations (time/sec) |
|---|---|---|---|---|---|
| Ink Including Dye | Speed-Priority | 13.3 | 72 | 10.8 | 1/12 |
| | Quality-Priority | 3.0 | 120 | 3.6 | 1/8 |
| Ink Including Pigments | Speed-Priority | 13.3 | 180 | 10.8 | 1/12 |
| | Quality-Priority | 3.0 | 180 | 3.6 | 1/3 |

In the case of the Table.2, when the ink includes dye, the control conditions are the same as those in the Table.1. When the ink includes pigments, the number of jettings of the drops of the ink during one flushing operation is remarkably increased.

As described above, according to the embodiment, the control condition for the flushing operations is changed based on the least volume of the drop of the ink and the kind of the ink. Thus, the flushing operations can be performed suitably for various printing conditions including the kind of the ink. Thus, it can be more surely prevented that the nozzle is clogged with the ink.

Figure 13:
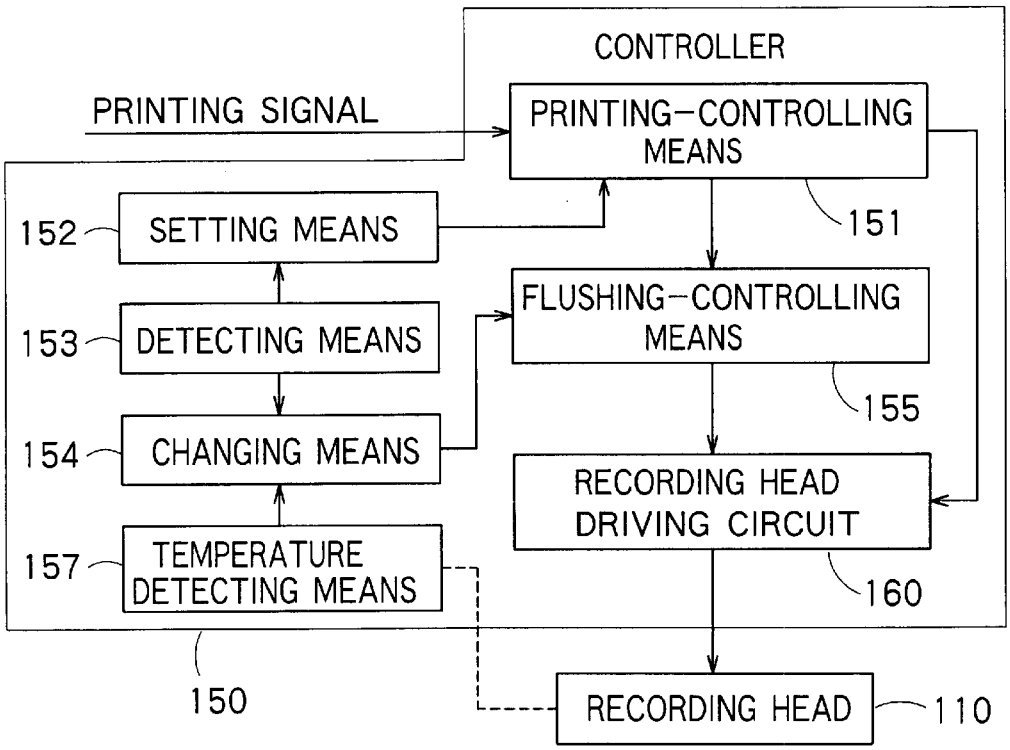
FIG. 13 is a schematic block diagram of an ink-jetting recording apparatus of another embodiment according to the invention.

FIG. 13 is a schematic block diagram of an ink-jetting recording apparatus of another embodiment.

The ink-jetting recording apparatus of the embodiment is provided with temperature detecting means 157 that can detect a temperature of the ink. The temperature detecting means 157 may be arranged near to the nozzle of the recording head 110. In the case, the changing means 154 is adapted to change the control condition for the flushing operations based on the result detected by the detecting means 153 and a result detected by the temperature detecting means 157. Another structure is the same as the embodiment shown in FIG. 8.

In general, viscosity of the ink may reduce as the temperature of the ink rises. On the contrary, viscosity of the ink in or near to the nozzle may remarkably increase when the ink is exposed to atmosphere of a high temperature. Thus, in the embodiment, as shown in Table.3, the changing means 154 changes the control condition for the flushing operations, for example a volume of drops of the ink jetted during the flushing operations, based on a change of the temperature of the ink.

TABLE 3

| Temperature | Mode | Least Volume of Drop of Ink (PL) | Number of Jettings of Drops of Ink During one Flushing Operation (shot) | Jetting Period of Drops of Ink During one Flushing Operation (kHz) | performing Period of Flushing Operations (time/sec) |
|---|---|---|---|---|---|
| Not Less than 30° C. | Speed-Priority | 13.3 | 120 | 10.8 | 1/12 |
| | Quality-Priority | 3.0 | 180 | 3.6 | 1/8 |
| 20° C.–30° C. | Speed-Priority | 13.3 | 72 | 10.8 | 1/12 |
| | Quality-Priority | 3.0 | 120 | 3.6 | 1/8 |
| Less than 20° C. | Speed-Priority | 13.3 | 120 | 10.8 | 1/12 |
| | Quality-Priority | 3.0 | 180 | 3.6 | 1/8 |

In the case of the Table.3, if a temperature detected by the temperature detecting means 157 is not less than 30° C. or less than 20° C., the number of jettings of the drops of the ink during one flushing operation is remarkably increased.

As described above, according to the embodiment, the control condition for the flushing operations is changed based on the least volume of the drop of the ink and the temperature of the ink. Thus, the flushing operations can be performed suitably for a state of the viscosity of the ink affected by the temperature of the ink. Thus, it can be more surely prevented that the nozzle is clogged with the ink.

In addition, in the above respective embodiments that can perform the flushing operations, each of the number of jettings of the drops of the ink during one flushing operation, the jetting period of the drops of the ink during one flushing operation and the interval (period) between any two successive flushing operations can be freely selected and changed. In addition to the above parameters, a voltage of a driving pulse for the flushing operations can be changed.

In addition, as described above, the printer controller 44 can be materialized by a computer system. A program for materializing the above one or more components in a computer system, and a storage unit 301 storing the program and capable of being read by a computer, are intended to be protected by this application.

In addition, when the above one or more components may be materialized in a computer system by using a general program such as an OS, a program including a command or commands for controlling the general program, and a storage unit 302 storing the program and capable of being read by a computer, are intended to be protected by this application.

Each of the storage units 301 and 302 can be not only a substantial object such as a floppy disk or the like, but also a network for transmitting various signals.

The above description is given for the ink-jetting printer 1 as a liquid jetting apparatus of a first embodiment according to the invention. However, this invention is intended to apply to general liquid jetting apparatuses widely. For example, the liquid jetting apparatus may be a manufacturing unit for color filters of a display apparatus such as LCD. A liquid may be glue, nail polish, a bonding agent, a hardened coating liquid or the like, instead of the ink.

What is claimed is:

1. A liquid jetting apparatus comprising a head having a nozzle, a recovering unit that can recover a suitable viscosity of liquid in the nozzle from an increased viscosity thereof, a pressure-generating unit that can change a pressure of liquid in the nozzle in order to jet a drop of the liquid from the nozzle, based on jetting data, an obtaining unit that can obtain minimum-volume information of the drop of the liquid to be jetted from the nozzle by the pressure-generating unit, and a controller that can control the recovering unit, based on the minimum-volume information obtained by the obtaining unit.

2. A liquid jetting apparatus according to claim 1, wherein:

the head can move in a main scanning direction, the pressure-generating unit can jet a plurality of drops of the liquid having different volumes from the nozzle during one scanning movement, and the obtaining unit can obtain a least volume of the plurality of drops of the liquid to be jetted by the pressure-generating unit, as the minimum-volume information.

3. A liquid jetting apparatus according to claim 1, wherein:

the obtaining unit is adapted to obtain the minimum-volume information of the drop of the liquid to be jetted from the nozzle, based on the jetting data.

4. A liquid jetting apparatus according to claim 1, wherein:

the obtaining unit is adapted to obtain the minimum-volume information of the drop of the liquid, by measuring a least volume of the drop of the liquid actually jetted from the nozzle.

5. A liquid jetting apparatus according to claim 1, wherein:

the controller is adapted to control the recovering unit, based on information about a kind of the liquid.

6. A liquid jetting apparatus according to claim 5, wherein:

the head is connected to a liquid cartridge that can supply the liquid to the head, and the liquid cartridge is provided with a kind-information storage that can store the information about the kind of the liquid in the liquid cartridge.

7. A liquid jetting apparatus according to claim 1, further comprising:

a sensor that can detect a state of environment where the liquid jetting apparatus is used, wherein the controller is adapted to control the recovering unit, based on an output from the sensor.

8. A liquid jetting apparatus according to claim 1, further comprising:

a temperature sensor that can detect a temperature of the liquid in or near to the nozzle, wherein the controller is adapted to control the recovering unit, based on an output from the temperature sensor.

9. A liquid jetting apparatus according to claim 1, wherein:

the recovering unit is adapted to perform a micro-vibrating operation during which a meniscus of the liquid in the nozzle is caused to minutely vibrate.

10. A liquid jetting apparatus according to claim 9, wherein:

the controller is adapted to change a number of micro-vibrations in the micro-vibrating operation performed by the recovering unit, based on the minimum-volume information obtained by the obtaining unit.

11. A liquid jetting apparatus according to claim 9, wherein:

the controller is adapted to change a repeating cycle of the micro-vibrating operation performed by the recovering unit, based on the minimum-volume information obtained by the obtaining unit.

12. A liquid jetting apparatus according to claim 9, wherein:

the controller is adapted to change an amplitude the micro-vibrating operation performed by the recovering unit, based on the minimum-volume information obtained by the obtaining unit.

13. A liquid jetting apparatus according to claim 1, wherein:

the recovering unit is adapted to perform a flushing operation during which drops of the liquid in the nozzle having an increased viscosity are discharged.

14. A liquid jetting apparatus according to claim 13, wherein:

the controller is adapted to change a number of the drops of the liquid discharged in the flushing operation performed by the recovering unit, based on the minimum-volume information obtained by the obtaining unit.

15. A liquid jetting apparatus according to claim 13, wherein:

the controller is adapted to change a discharging period of the drops of the liquid discharged in the flushing operation performed by the recovering unit, based on the minimum-volume information obtained by the obtaining unit.

16. A liquid jetting apparatus according to claim 13, wherein:

the controller is adapted to change a performing period of a plurality of flushing operations performed by the recovering unit, based on the minimum-volume information obtained by the obtaining unit.

17. A controlling unit for controlling a liquid jetting apparatus including: a head having a nozzle, a recovering unit that can recover a suitable viscosity of liquid in the nozzle from an increased viscosity thereof, a pressure-generating unit that can change a pressure of liquid in the nozzle in order to jet a drop of the liquid from the nozzle, based on jetting data, and an obtaining unit that can obtain minimum-volume information of the drop of the liquid to be jetted from the nozzle by the pressure-generating unit; comprising:

a controller that can control the recovering unit, based on the minimum-volume information obtained by the obtaining unit.

18. A controlling unit according to claim 17, wherein:

the head can move in a main scanning direction, the pressure-generating unit can jet a plurality of drops of the liquid having different volumes from the nozzle during one scanning movement, and the obtaining unit can obtain a least volume of the plurality of drops of the liquid to be jetted by the pressure-generating unit, as the minimum-volume information.

19. A controlling unit according to claim 17, wherein:

the obtaining unit is adapted to obtain the minimum-volume information of the drop of the liquid to be jetted from the nozzle, based on the jetting data.

20. A controlling unit according to claim 17, wherein:

the obtaining unit is adapted to obtain the minimum-volume information of the drop of the liquid, by measuring a least volume of the drop of the liquid actually jetted from the nozzle.

21. A controlling unit according to claim 17, wherein:

the controller is adapted to control the recovering unit, based on information about a kind of the liquid.

22. A controlling unit according to claim 21, wherein:

the head is connected to a liquid cartridge that can supply the liquid to the head, and the liquid cartridge is provided with a kind-information storage that can store the information about the kind of the liquid in the liquid cartridge.

23. A controlling unit according to claim 17, wherein:

the controller is adapted to control the recovering unit, based on an output from a sensor that can detect a state of environment where the liquid jetting apparatus is used.

24. A controlling unit according to claim 17, wherein:

the controller is adapted to control the recovering unit, based on an output from a temperature sensor that can detect a temperature of the liquid in or near to the nozzle.

25. A controlling unit according to claim 17, wherein:

the recovering unit is adapted to perform a micro-vibrating operation during which a meniscus of the liquid in the nozzle is caused to minutely vibrate.

26. A controlling unit according to claim 25, wherein:

the controller is adapted to change a number of micro-vibrations in the micro-vibrating operation performed by the recovering unit, based on the minimum-volume information obtained by the obtaining unit.

27. A controlling unit according to claim 25, wherein:

the controller is adapted to change a repeating cycle of the micro-vibrating operation performed by the recovering unit, based on the minimum-volume information obtained by the obtaining unit.

28. A controlling unit according to claim 25, wherein:

the controller is adapted to change an amplitude the micro-vibrating operation performed by the recovering unit, based on the minimum-volume information obtained by the obtaining unit.

29. A controlling unit according to claim 17, wherein:

the recovering unit is adapted to perform a flushing operation during which drops of the liquid in the nozzle having an increased viscosity are discharged.

30. A controlling unit according to claim 29, wherein:

the controller is adapted to change a number of the drops of the liquid discharged in the flushing operation performed by the recovering unit, based on the minimum-volume information obtained by the obtaining unit.

31. A controlling unit according to claim 29, wherein:

the controller is adapted to change a discharging period of the drops of the liquid discharged in the flushing operation performed by the recovering unit, based on the minimum-volume information obtained by the obtaining unit.

32. A controlling unit according to claim 29, wherein:

the controller is adapted to change a performing period of a plurality of flushing operations performed by the recovering unit, based on the minimum-volume information obtained by the obtaining unit.

33. A storage unit capable of being read by a computer, storing a program for materializing a controlling unit; for controlling a liquid jetting apparatus including: a head having a nozzle, a recovering unit that can recover a suitable viscosity of liquid in the nozzle from an increased viscosity thereof, a pressure-generating unit that can change a pressure of liquid in the nozzle in order to jet a drop of the liquid from the nozzle, based on jetting data, and an obtaining unit that can obtain minimum-volume information of the drop of the liquid to be jetted from the nozzle by the pressure-generating unit; comprising: a controller that can control the recovering unit, based on the minimum-volume information obtained by the obtaining unit.

34. A storage unit capable of being read by a computer, storing a program including a command for controlling a second program executed by a computer system including a computer, the program is executed by the computer system to control the second program to materialize a controlling unit; for controlling a liquid jetting apparatus including: a head having a nozzle, a recovering unit that can recover a suitable viscosity of liquid in the nozzle from an increased viscosity thereof, a pressure-generating unit that can change a pressure of liquid in the nozzle in order to jet a drop of the liquid from the nozzle, based on jetting data, and an obtaining unit that can obtain minimum-volume information of the drop of the liquid to be jetted from the nozzle by the pressure-generating unit; comprising: a controller that can control the recovering unit, based on the minimum-volume information obtained by the obtaining unit.

* * * * *